US011329433B2

(12) United States Patent
Yang et al.

(10) Patent No.: US 11,329,433 B2
(45) Date of Patent: May 10, 2022

(54) PLUG CONNECTOR WITH CONDUCTIVE ELASTIC SEALING MEMBER FOR EFFECTIVELY PREVENTING EMI LEAKAGE DURING MATING

(71) Applicant: Molex, LLC, Lisle, IL (US)

(72) Inventors: Hui-Hsuan Yang, New Taipei (TW); Yen-Lin Chen, New Taipei (TW); Chen-Min Lin, New Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/985,224

(22) Filed: Aug. 5, 2020

(65) Prior Publication Data

US 2021/0050692 A1 Feb. 18, 2021

(30) Foreign Application Priority Data

Aug. 12, 2019 (CN) ..... 201921302938.3

(51) Int. Cl.
*H01R 13/6591* (2011.01)
*H01R 13/6581* (2011.01)

(52) U.S. Cl.
CPC ..... *H01R 13/6591* (2013.01); *H01R 13/6581* (2013.01)

(58) Field of Classification Search
CPC ..... H01R 13/6581; H01R 13/6582; H01R 13/6583; H01R 13/6584; H01R 13/6591
USPC ..... 439/607.17, 607.2, 607.41; 174/354, 174/355, 359
See application file for complete search history.

(56) References Cited

U.S. PATENT DOCUMENTS 4,857,668 A * 8/1989 Buonanno ..... H05K 9/0015 174/354
5,045,635 A * 9/1991 Kaplo ..... H05K 9/0015 174/354
6,075,205 A * 6/2000 Zhang ..... H05K 9/0015 174/358
6,173,970 B1 * 1/2001 Choudary ..... F16J 15/028 277/644
6,663,431 B1 * 12/2003 Brehm ..... H01R 13/65912 439/607.41
7,340,862 B2 * 3/2008 Baratin ..... B60J 10/24 49/475.1
7,566,246 B2 * 7/2009 Moore ..... G02B 6/4201 439/607.01

(Continued)

FOREIGN PATENT DOCUMENTS

CN 205595559 U 9/2016

*Primary Examiner* — Peter G Leigh

(57) ABSTRACT

The present disclosure provides a plug connector adapted to insert into a receptacle connector, the receptacle connector includes a cage having an opening. The plug connector includes a metal shell and a conductive elastic member. The metal shell is provided with a recessed groove. The conductive elastic member includes a conductive elastic body, the conductive elastic body has a holding portion held in the recessed groove and a first electromagnetic shielding portion extending out of the recessed groove from the holding portion, when the plug connector is inserted forwardly into the receptacle connector, the first electromagnetic shielding portion enters into the opening of the cage of the receptacle connector and mechanically and electrically contacts the cage and the metal shell. However, some embodiments may not include a holding portion or recessed groove.

20 Claims, 19 Drawing Sheets

(56) References Cited

U.S. PATENT DOCUMENTS 7,612,299 B2 * 11/2009 Chen ..... H05K 9/0058 174/359
7,928,324 B2 * 4/2011 Moore ..... H05K 9/0058 174/354
7,955,003 B2 * 6/2011 Teo ..... H01R 13/6275 385/92
7,957,159 B2 * 6/2011 Wu ..... H05K 9/0016 361/818
8,035,975 B2 * 10/2011 Wu ..... H01R 13/6658 361/747
8,058,569 B2 * 11/2011 Kline ..... F16J 15/027 174/355
8,064,207 B2 * 11/2011 Wu ..... G02B 6/4284 361/747
8,183,470 B2 * 5/2012 Zhang ..... H05K 9/0058 174/359
8,506,331 B2 * 8/2013 Wu ..... H01R 13/6658 439/607.18
8,562,373 B2 * 10/2013 Wu ..... H01R 13/6658 439/352
8,597,045 B2 * 12/2013 Zhu ..... H01R 13/506 439/357
8,599,567 B2 * 12/2013 Wu ..... G02B 6/4261 361/752
8,622,770 B2 * 1/2014 Teo ..... H05K 9/0058 439/607.2
8,668,515 B2 * 3/2014 Wu ..... H01R 13/633 439/352
8,714,840 B2 * 5/2014 Matsue ..... G02B 6/4278 385/92
8,911,256 B2 * 12/2014 Qiao ..... H01R 13/6581 439/607.18
9,039,300 B2 * 5/2015 Kondo ..... G02B 6/4256 385/92
9,450,338 B2 * 9/2016 Reeves ..... H01R 13/631
9,768,559 B2 * 9/2017 Li ..... H01R 13/6582
10,180,549 B1 * 1/2019 Hino ..... G02B 6/4277
2004/0261322 A1 * 12/2004 Baratin ..... B60J 10/21 49/498.1
2006/0140552 A1 * 6/2006 Mizue ..... G02B 6/4261 385/92
2006/0279937 A1 * 12/2006 Manson ..... G02B 6/4248 361/724
2007/0117458 A1 * 5/2007 Winker ..... G02B 6/4277 439/607.01
2009/0050360 A1 * 2/2009 Chen ..... H05K 9/0058 174/351
2009/0147493 A1 * 6/2009 Wu ..... H05K 9/0016 361/818
2010/0091466 A1 * 4/2010 Wu ..... G02B 6/4284 361/747
2010/0091467 A1 * 4/2010 Wu ..... H01R 13/6658 361/747
2010/0142898 A1 * 6/2010 Teo ..... H01R 13/6275 385/88
2011/0206328 A1 * 8/2011 Wang ..... G02B 6/4277 385/94
2011/0279984 A1 * 11/2011 Su ..... H01R 13/6582 361/736
2012/0190224 A1 * 7/2012 Wu ..... H01R 13/633 439/157
2012/0214324 A1 * 8/2012 Wu ..... H01R 13/6658 439/271
2012/0220152 A1 * 8/2012 Wu ..... H01R 13/6581 439/350
2012/0252256 A1 * 10/2012 Zhu ..... H01R 13/506 439/357
2012/0288240 A1 * 11/2012 Kondo ..... G02B 6/4256 385/92
2013/0231005 A1 * 9/2013 Qiao ..... H01R 13/6581 439/607.55
2015/0256260 A1 * 9/2015 Kurashima ..... H04B 10/40 398/135
2019/0011655 A1 * 1/2019 Hino ..... G02B 6/4261
2019/0098804 A1 * 3/2019 Wang ..... H04B 10/40

* cited by examiner

PLUG CONNECTOR WITH CONDUCTIVE ELASTIC SEALING MEMBER FOR EFFECTIVELY PREVENTING EMI LEAKAGE DURING MATING

RELATED APPLICATION

This application claims priority to Chinese Application Serial No. 201921302938.3, filed on Aug. 12, 2019, which is incorporated by reference in its entirety.

TECHNICAL FIELD

The present disclosure relates to a plug connector, particularly relates to a plug connector with a conductive elastic member for shielding electromagnetic interference.

BACKGROUND

Chinese utility model patent application issuance publication No. CN205595559U discloses a plug connector whose EMI gasket is made of a conductive plastic, the conductive plastic has the characteristics of good conductivity, anti-static electricity property, high structural strength, resistance to aging, low production cost, easy processing and good EMI (Electromagnetic Interference) protection function and the like. The EMI gasket includes a plurality of side edges and a through hole enclosed by the side edges, an area of the through hole is smaller than a cross-sectional area of a body portion of a metal shell. The EMI gasket is sheathed rearwardly on an insertion portion of the metal shell, each side edge presses against the body portion, an inner edge of the each side edge is engaged with the insertion portion with interference fit, an outer edge of the each side edge protrudes from a peripheral surface of the body portion. When the plug connector is mated with the receptacle connector, a mating portion of a circuit board is inserted into a corresponding insertion hole of the receptacle connector following the insertion portion of the metal shell, and each side edge of the EMI gasket shields the insertion hole from outside and seals a gap between the plug connector and the insertion hole of the receptacle connector to prevent EMI leakage. However, when the plug connector is mated with the receptacle connector, the gap still exists between an inner side surface of the insertion hole of the receptacle connector and an outer side surface of the plug connector, furthermore, the EMI mainly affects the top portion and the bottom portion of the plug connector, and has little effect on both side portions under general case, although each side edge of the EMI gasket shields the insertion hole from outside, the EMI gasket is made of conductive plastic, whose material is harder, it is practically difficult to make all side edges of the EMI gasket compliantly contact the edge of the insertion hole, especially to the top portion and the bottom portion of the plug connector, so it is easy to produce pores that cause EMI leakage.

United States patent application issuance publication No. U.S. Pat. No. 8,622,770B2 discloses a plug connector whose conductive foam physically and electrically contacts an edge of an opening of a cage of the receptacle connector to form sealing which reduces or prevents EMR (Electromagnetic Radiation) leakage from the opening, thereby reducing or preventing EMI (Electromagnetic Interference) from the surrounding devices. However, although the use of the elastic conductive foam can better seal the gap between the plug connector and the receptacle connector, but only using a conductive carrier, can the conductive foam be stably mounted to the shell of the plug connector, however, the structure of the plug connector is more complicated and the production cost is higher due to the conductive carrier.

SUMMARY

Therefore, an object of the present disclosure is to provide a plug connector which can improve at least one of problems in the prior art.

Accordingly, in some embodiments, a plug connector of the present disclosure is adapted to insert into a receptacle connector, the receptacle connector comprises a cage having an opening. The plug connector comprises a metal shell and a conductive elastic member. The metal shell is provided with a recessed groove. The conductive elastic member comprises a conductive elastic body, the conductive elastic body has a holding portion held in the recessed groove and a first electromagnetic shielding portion extending out of the recessed groove from the holding portion, when the plug connector is inserted forwardly into the receptacle connector, the first electromagnetic shielding portion enters into the opening of the cage of the receptacle connector and mechanically and electrically contacts the cage and the metal shell.

In some embodiments, the conductive elastic body further has a second electromagnetic shielding portion which is positioned behind the first electromagnetic shielding portion, when the plug connector is inserted forwardly into the receptacle connector, the second electromagnetic shielding portion mechanically and electrically contacts an edge of the cage positioned at the opening.

In some embodiments, the metal shell comprises a top portion and a bottom portion, the recessed groove is provided to one of the top portion and the bottom portion.

In some embodiments, the metal shell comprises a top portion and a bottom portion, the recessed groove is provided to one of the top portion and the bottom portion, the metal shell is further provided with another recessed groove provided to the other of the top portion and the bottom portion, the conductive elastic member further comprises another conductive elastic body provided to the another recessed groove.

In some embodiments, the another conductive elastic body has a holding portion held in the another recessed groove and a first electromagnetic shielding portion extending out of the another recessed groove from the holding portion of the another conductive elastic body, when the plug connector is inserted forwardly into the receptacle connector, the first electromagnetic shielding portion of the another conductive elastic body enters into the opening of the cage of the receptacle connector and mechanically and electrically contacts the cage and the metal shell.

In some embodiments, the another conductive elastic body further has a second electromagnetic shielding portion which is positioned behind the first electromagnetic shielding portion of the another conductive elastic body, when the plug connector is inserted forwardly into the receptacle connector, the second electromagnetic shielding portion of the another conductive elastic body mechanically and electrically contacts the edge of the cage positioned at the opening.

In some embodiments, the conductive elastic member further comprises two side conductive elastic bodies which are respectively connected to two ends of the conductive elastic bodies.

In some embodiments, each side conductive elastic body has a third electromagnetic shielding portion, when the plug connector is inserted forwardly into the receptacle connector, the third electromagnetic shielding portion enters into the opening of the cage of the receptacle connector and mechanically and electrically contacts the cage and the metal shell.

In some embodiments, each side conductive elastic body further has a fourth electromagnetic shielding portion which is positioned behind the third electromagnetic shielding portion, when the plug connector is inserted forwardly into the receptacle connector, the fourth electromagnetic shielding portion mechanically and electrically contacts the edge of the cage positioned at the opening.

In some embodiments, a front end of the first electromagnetic shielding portion has a guiding structure, the guiding structure has a guiding surface which is an oblique surface or an arc surface extending obliquely toward the rear and away from the metal shell.

In some embodiments, the conductive elastic body further has a supporting portion which is positioned behind the second electromagnetic shielding portion of the conductive elastic body and abuts against the metal shell.

In some embodiments, the conductive elastic body further has a supporting portion which is positioned behind the second electromagnetic shielding portion of the conductive elastic body and abuts against the metal shell, and the another conductive elastic body further has a supporting portion which is positioned behind the second electromagnetic shielding portion of the another conductive elastic body and abuts against the metal shell.

In some embodiments, a material of the conductive elastic member is conductive rubber or conductive foam.

Therefore, in some embodiments, a plug connector of the present disclosure is adapted to insert into a receptacle connector, the receptacle connector comprises a cage having an opening. The plug connector comprises a metal shell and a conductive elastic member. The conductive elastic member comprises a conductive elastic body held to the metal shell, the conductive elastic body has a first electromagnetic shielding portion and a second electromagnetic shielding portion positioned behind the first electromagnetic shielding portion, a height of the first electromagnetic shielding portion relative to the metal shell is lower than a height of the second electromagnetic shielding portion relative to the metal shell, when the plug connector is inserted forwardly into the receptacle connector, the first electromagnetic shielding portion enters into the opening of the cage of the receptacle connector and mechanically and electrically contacts the cage and the metal shell, the second electromagnetic shielding portion mechanically and electrically contacts an edge of the cage positioned at the opening.

In some embodiments, the metal shell comprises a top portion and a bottom portion, the conductive elastic body is held to one of the top portion and the bottom portion.

In some embodiments, the metal shell comprises a top portion and a bottom portion, the conductive elastic body is held to one of the top portion and the bottom portion, the conductive elastic member further comprises an another conductive elastic body held to the other of the top portion and the bottom portion.

In some embodiments, the another conductive elastic body has a first electromagnetic shielding portion and a second electromagnetic shielding portion positioned behind the first electromagnetic shielding portion of the another conductive elastic body, a height of the first electromagnetic shielding portion of the another conductive elastic body relative to the metal shell is lower than a height of the second electromagnetic shielding portion of the another conductive elastic body relative to the metal shell, when the plug connector is inserted forwardly into the receptacle connector, the first electromagnetic shielding portion of the another conductive elastic body enters into the opening of the cage of the receptacle connector and mechanically and electrically contacts the cage and the metal shell, the second electromagnetic shielding portion of the another conductive elastic body mechanically and electrically contacts the edge of the cage positioned at the opening.

In some embodiments, the conductive elastic member further comprises two side conductive elastic bodies which are respectively connected to two ends of the two conductive elastic bodies.

In some embodiments, each conductive elastic body has a third electromagnetic shielding portion, when the plug connector is inserted forwardly into the receptacle connector, the third electromagnetic shielding portion enters into the opening of the cage of the receptacle connector and mechanically and electrically contacts the cage and the metal shell.

In some embodiments, each side conductive elastic body further has a fourth electromagnetic shielding portion positioned behind the third electromagnetic shielding portion, when the plug connector is inserted forwardly into the receptacle connector, the fourth electromagnetic shielding portion mechanically and electrically contacts the edge of the cage positioned at the opening.

In some embodiments, the metal shell is provided with a recessed groove, and the conductive elastic body further has a holding portion held in the recessed groove.

In some embodiments, the metal shell is provided with recessed grooves, the conductive elastic body further has a holding portion held in the corresponding recessed groove, the another conductive elastic body further has a holding portion held in the corresponding recessed groove.

In some embodiments, the conductive elastic bodies further have a supporting portion positioned behind the second electromagnetic shielding portion of the conductive elastic body and abutting against the metal shell.

In some embodiments, the conductive elastic body has a supporting portion positioned behind the second electromagnetic shielding portion of the conductive elastic body and abutting against the metal shell, and the another conductive elastic body further has a supporting portion positioned behind the second electromagnetic shielding portion of the another conductive elastic body and abutting against the metal shell.

In some embodiments of the plug connector of the present disclosure, the gap between the cage and the metal shell is shielded by the conductive elastic member which mechanically and electrically contacts the cage and the metal shell so as to prevent the electromagnetic interference (EMI) from leaking out from the gap. Furthermore, the first electromagnetic shielding portion of the conductive elastic member, which is lower in height and positioned at the front, can enter into the opening of the cage of the receptacle connector and mechanically and electrically contacts the cage and the metal shell, and the second electromagnetic shielding portion, which is higher in height and positioned at the rear, can make the front end thereof mechanically and electrically contact the edge of the cage poisoned at the opening, so that the conductive elastic member has good shield sealing. The conductive elastic member can be stably provided to the plug connector through the engagement of the recessed groove and the holding portion. In addition, the conductive elastic member can also increase the mating stability of the plug connector and the receptacle connector during mating.

BRIEF DESCRIPTION OF THE DRAWINGS

Other features and technical effects of the present disclosure will be apparent in the embodiments referring to the accompanying figures, in which.

DETAILED DESCRIPTION OF THE PREFERRED EMBODIMENTS

Figure 1:
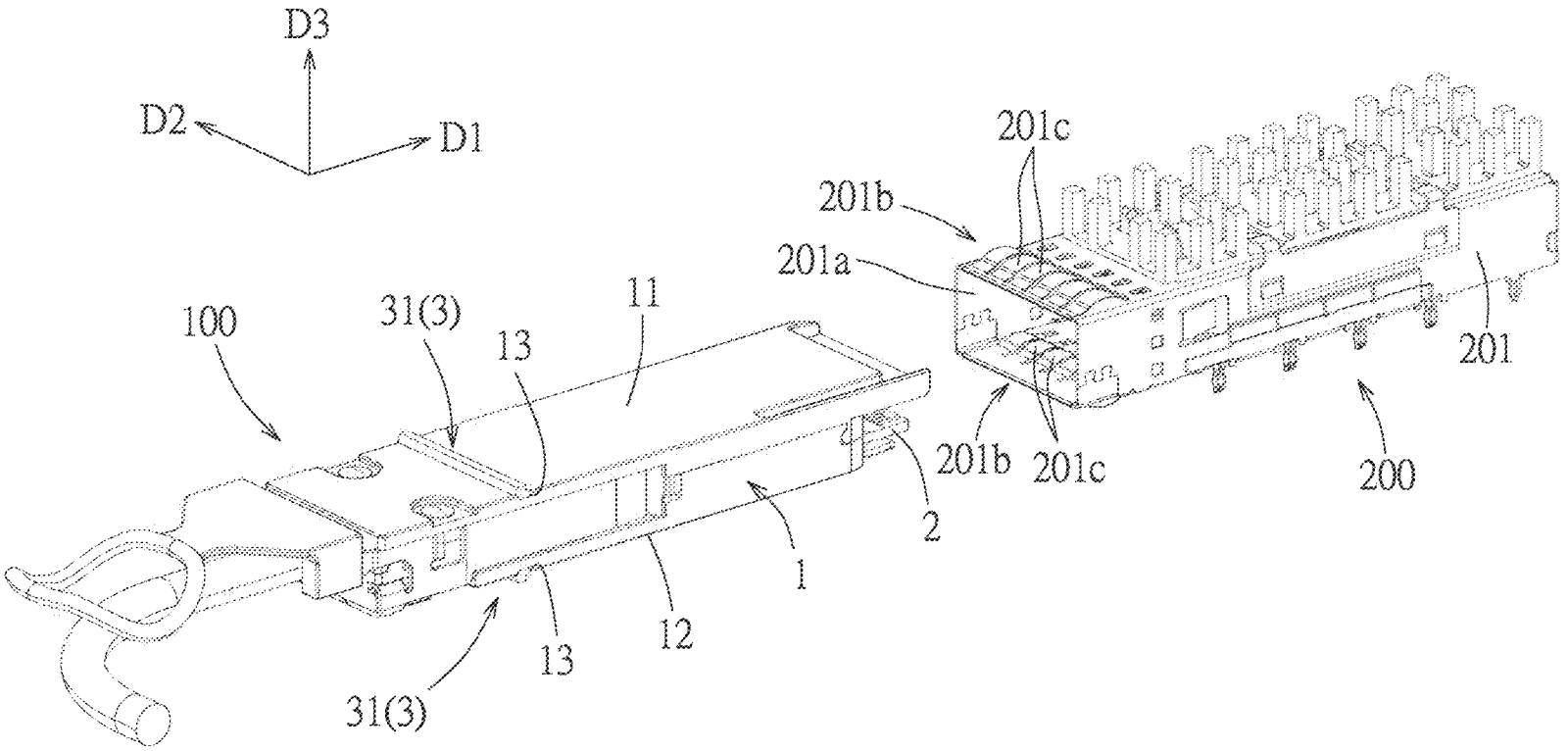
FIG. 1 is a perspective view of a first embodiment of a plug connector of the present disclosure and a receptacle connector, in which the first embodiment has not been inserted into the receptacle connector.
Figure 2:
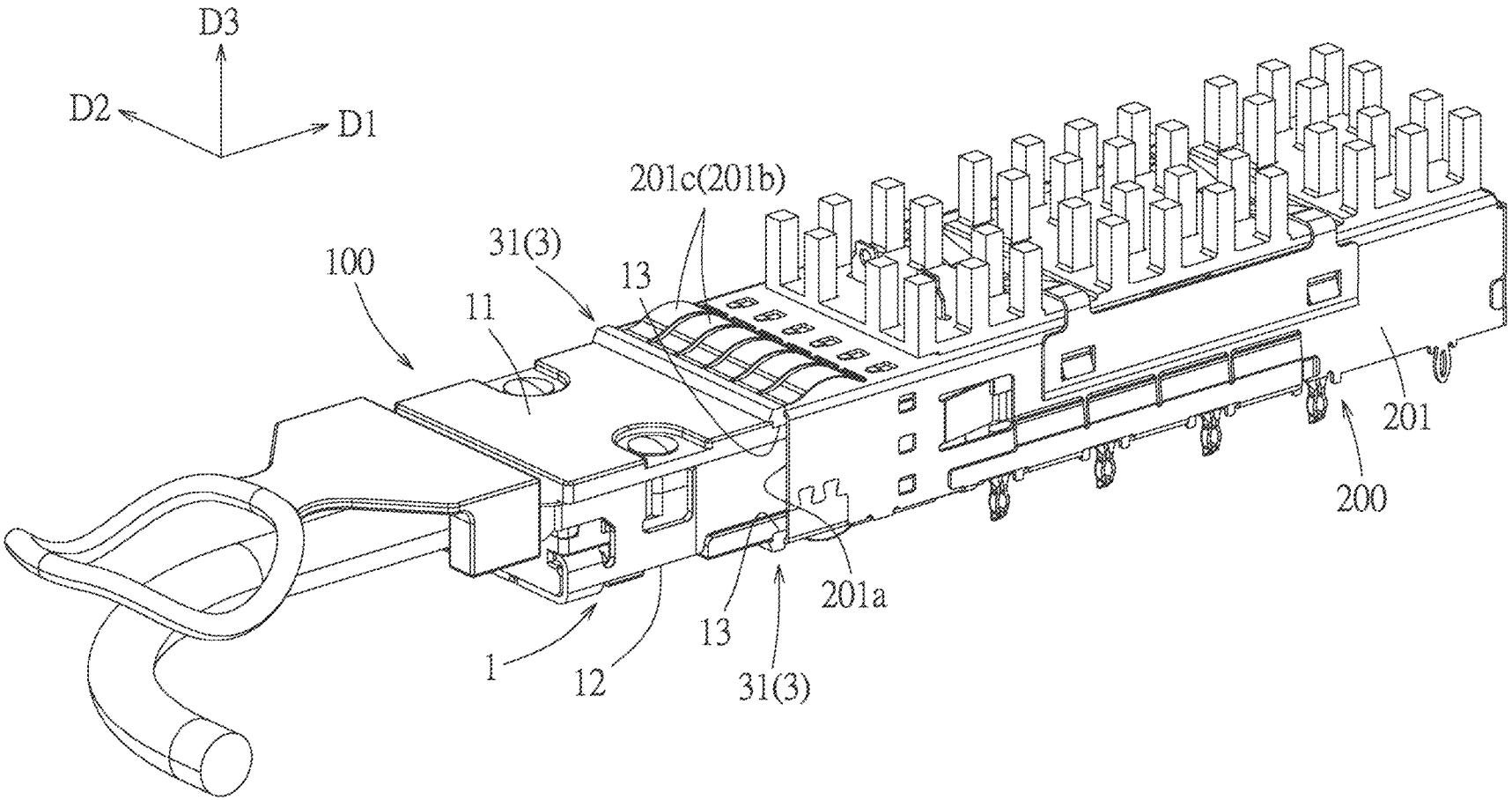
FIG. 2 is a perspective view of the first embodiment and the receptacle connector, in which the first embodiment has been inserted into the receptacle connector.
Figure 3:
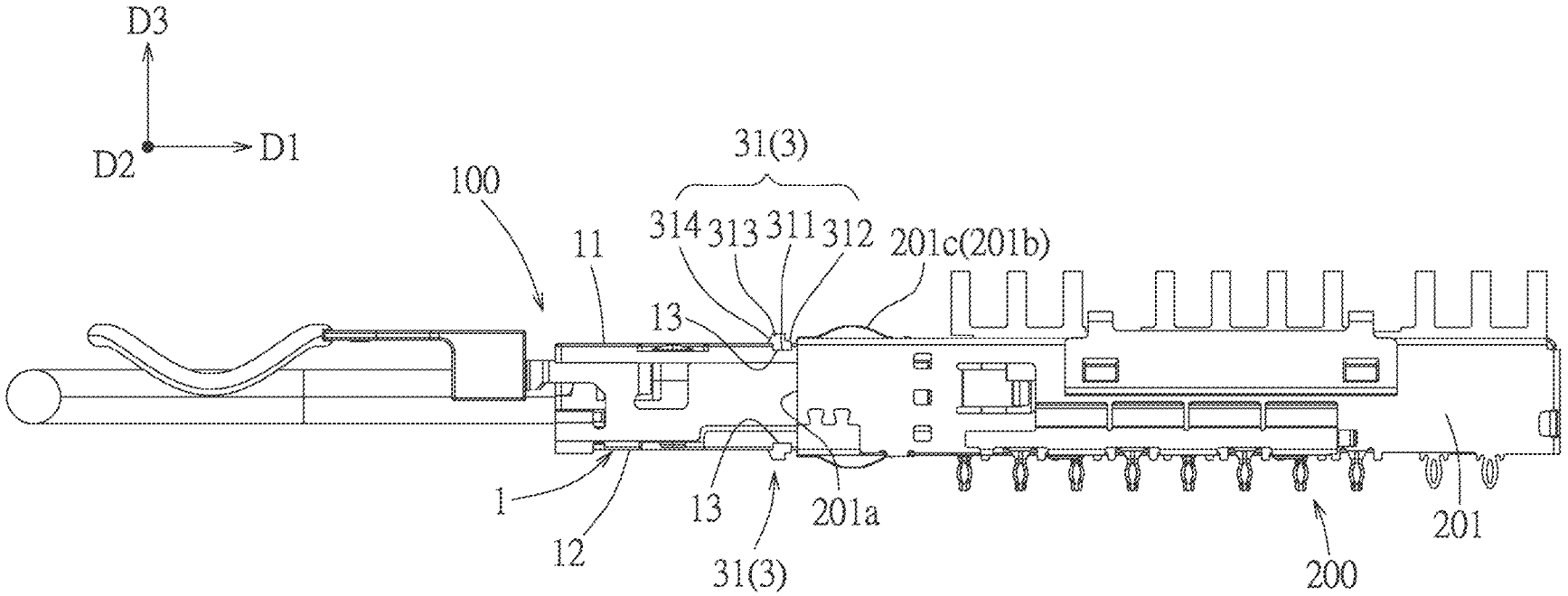
FIG. 3 is a side view of the first embodiment and the receptacle connector, in which the first embodiment has not been completely inserted into the receptacle connector.
Figure 4:
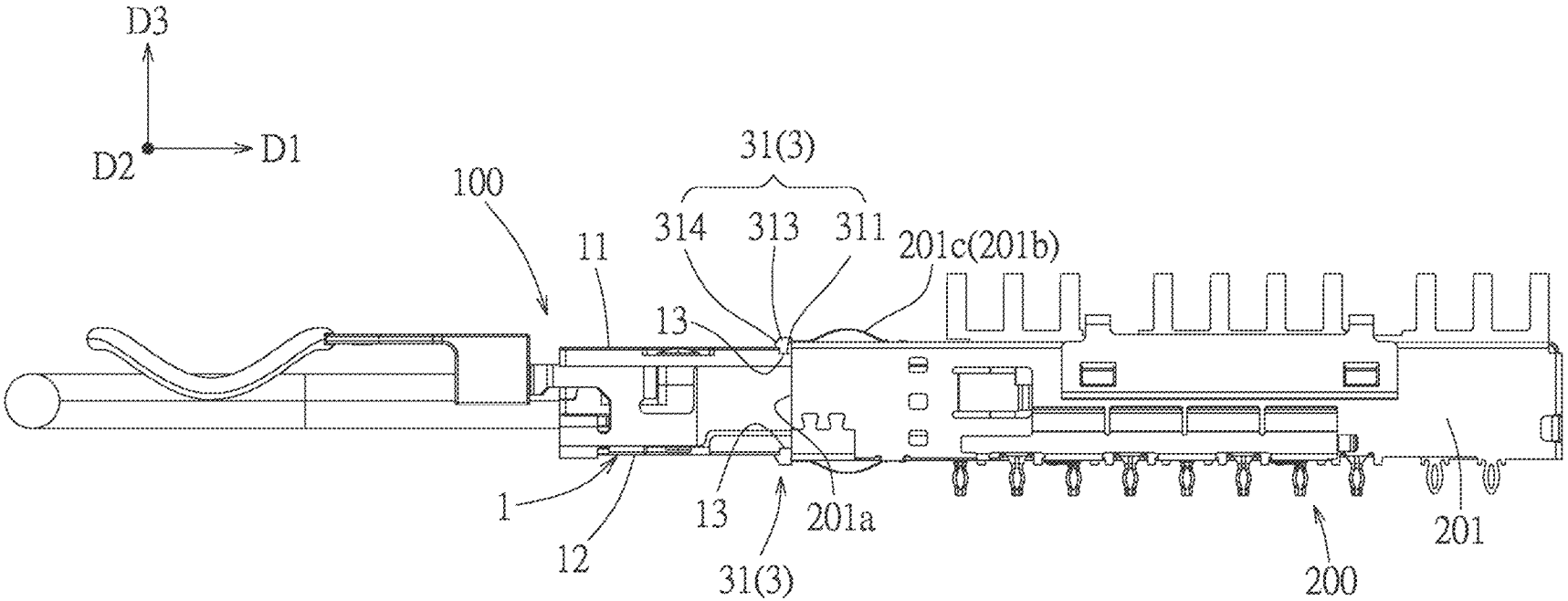
FIG. 4 is a side view of the first embodiment and the receptacle connector, in which the first embodiment has been completely inserted into the receptacle connector.
Figure 5:
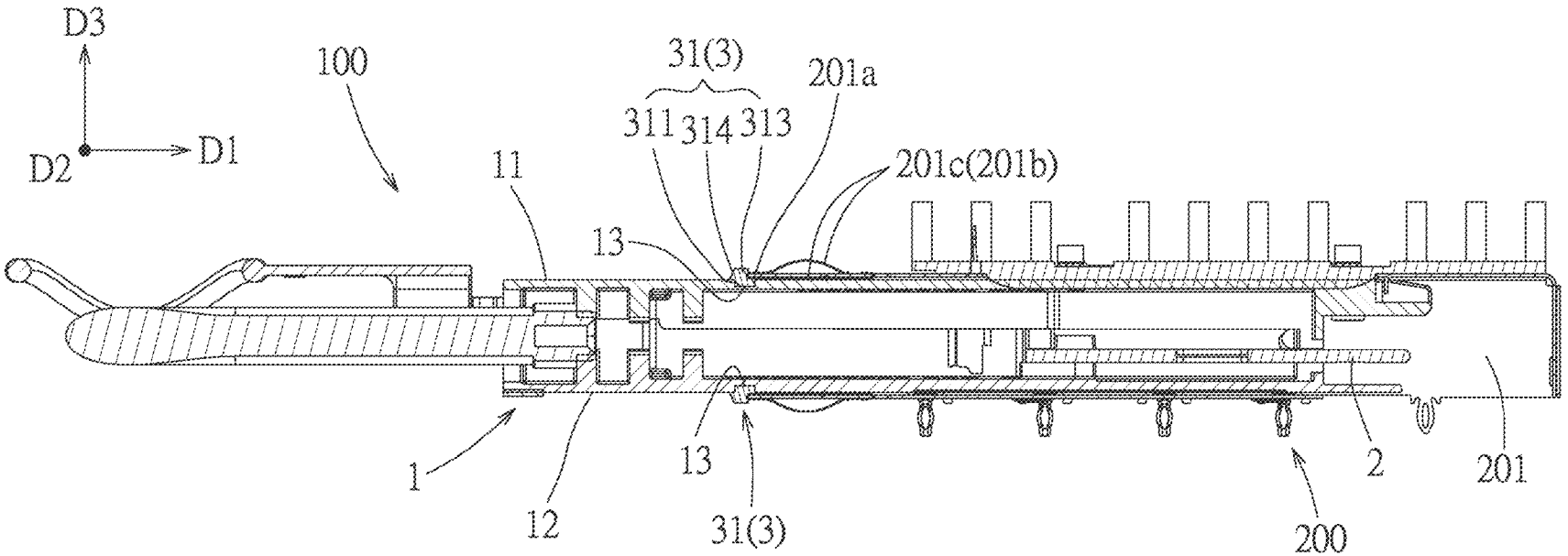
FIG. 5 is a cross-sectional view of the first embodiment and the receptacle connector, in which the first embodiment has been completely inserted into the receptacle connector.
Figure 6:
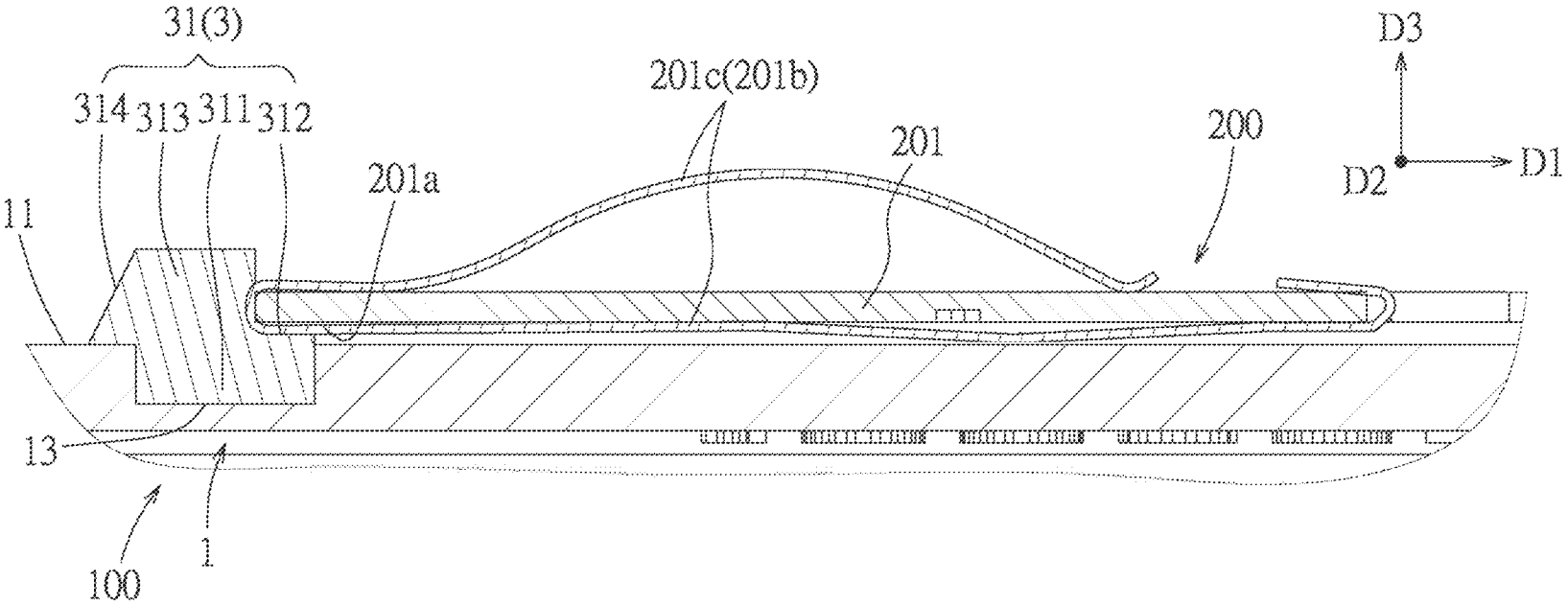
FIG. 6 is an incomplete partial enlarged view of FIG. 5.
Figure 7:
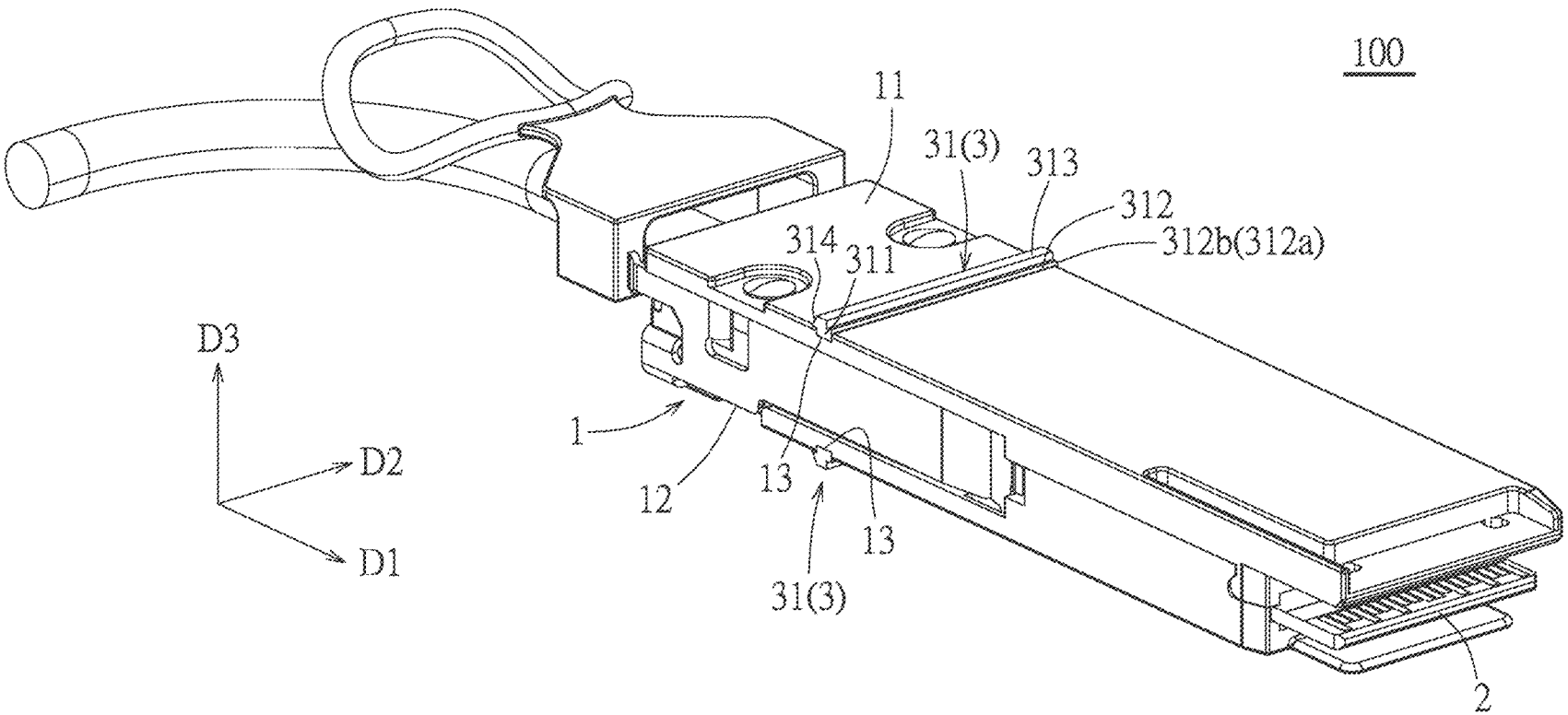
FIG. 7 is a perspective view of the first embodiment.
Figure 8:
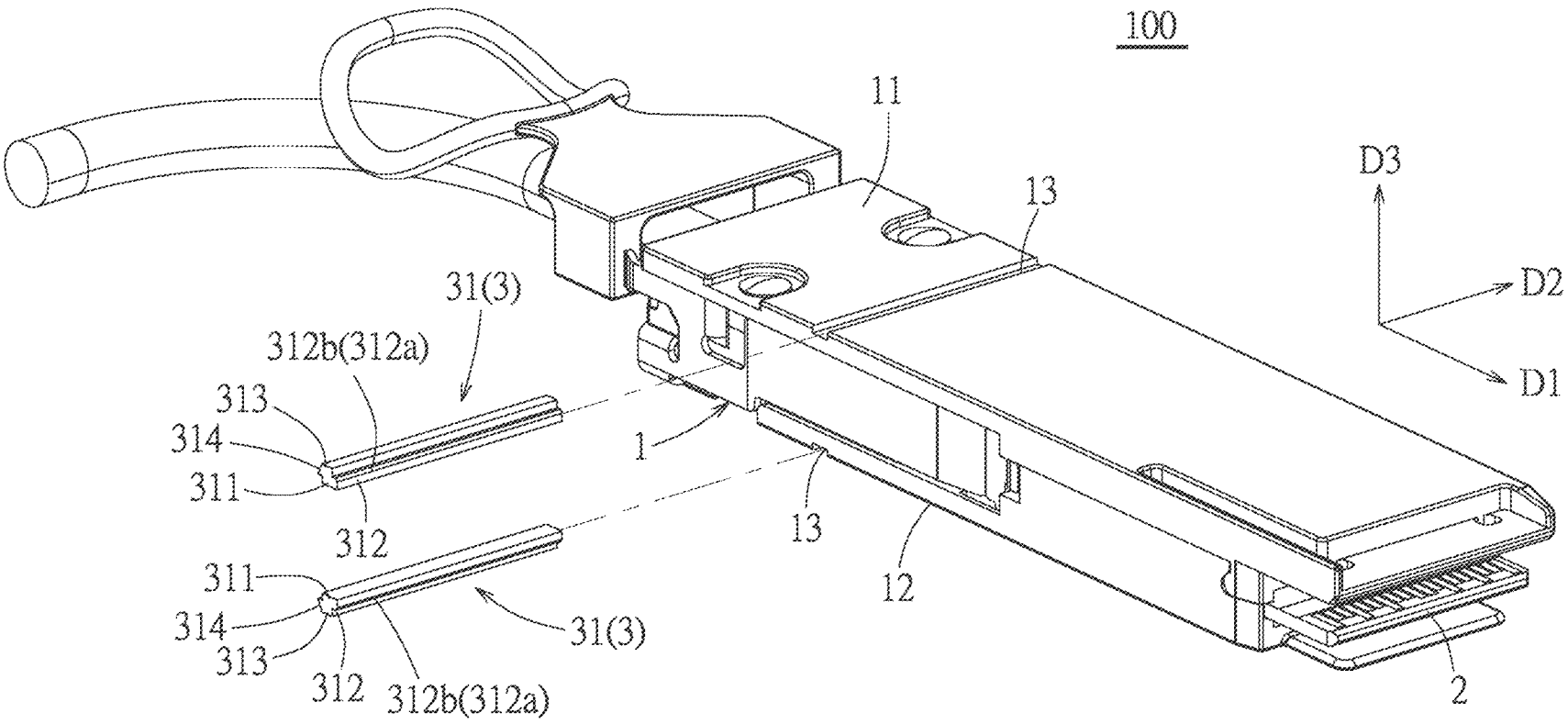
FIG. 8 is an exploded perspective view of FIG. 7, in which a conductive elastic member of the first embodiment is separated from a metal shell.
Figure 9:
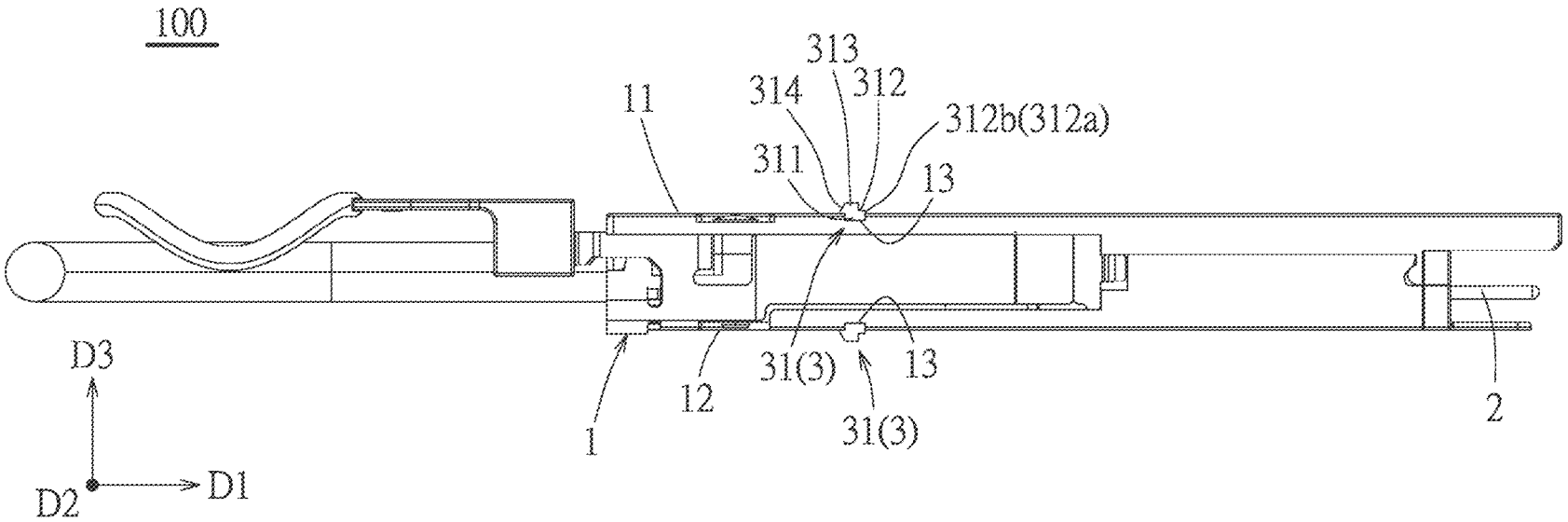
FIG. 9 is a side view of the first embodiment.

Before the present disclosure is described in detail, it should be noted that like elements are denoted by the same reference numerals in the following description.

Referring FIG. 1 to FIG. 4, a first embodiment of a plug connector 100 of the present disclosure is adapted to insert into a receptacle connector 200, the receptacle connector 200 includes a cage 201 having an opening 201*a* and a receptacle module (not shown) provided in the cage 201. Specifically, in the first embodiment, the cage 201 has grounding members 201*b* provided at upper and lower sides of the opening 201*a*, the grounding members 201*b* have a plurality of elastic fingers 201*c* distributed on an outer side of the cage 201 and an inner side of the cage 201, the elastic finger 201*c* of the plurality of elastic fingers 201*c* which is positioned on the outer side of the cage 201 is used to contact a case (not shown), the elastic finger 201*c* of the plurality of elastic fingers 201*c* which is positioned on the inner side of the cage 201 is used to contact the plug connector 100, it should be noted that, in other varied embodiments, the plurality of the elastic fingers 201*c* of the grounding members 201*b* may also be provided only on the outer side of the cage 201, so the present disclosure is not limited thereto. The plug connector 100 includes a metal shell 1, a mating circuit board 2, and a conductive elastic member 3.

Referring FIG. 3 and FIG. 5 to FIG. 9, the metal shell 1 extends forwardly in a front-rear direction D1 and is used to insert into the cage 201 via the opening 201*a*. The mating circuit board 2 extends in a left-right direction D2, is embedded and partially exposed in a front end of the metal shell 1, so as to be inserted into and mated with the receptacle module in the cage 201 when the metal shell 1 is inserted forwardly into the cage 201. The metal shell 1 includes a top portion 11 and a bottom portion 12 opposite to each other in an up-down direction D3, and the top portion 11 and the bottom portion 12 of the metal shell 1 each are provided with a recessed groove 13 extending in the left-right direction D2, in the first embodiment, cross sections of the two recessed grooves 13 are rectangular.

A material of the conductive elastic member 3 may be, for example, conductive rubber, conductive foam or other conductive materials with elasticity. The conductive elastic member 3 includes two conductive elastic bodies 31 which extend in the left-right direction D2 and are respectively held in the recessed groove 13 of the top portion 11 and the recessed groove 13 of the bottom portion 12, each conductive elastic body 31 has a holding portion 311 which is held in the corresponding recessed groove 13, a first electromagnetic shielding portion 312 which extends out of the corresponding recessed groove 13 from the holding portion 311, and a second electromagnetic shielding portion 313 which is positioned behind the first electromagnetic shielding portion 312 and connected to the first electromagnetic shielding portion 312 and the holding portion 311, a height of the first electromagnetic shielding portion 312 relative to the metal shell 1 is lower than a height of the second electromagnetic shielding portion 313 relative to the metal shell 1. And in the first embodiment, cross-sections of the holding portion 311, the first electromagnetic shielding portion 312 and the second electromagnetic shielding portion 313 are all rectangular, but the present disclosure is not limited thereto. When the plug connector 100 is inserted forwardly into the receptacle connector 200, the first electromagnetic shielding portion 312 enters into the opening 201*a* of the cage 201 of the receptacle connector 200 and mechanically and electrically and compressively contacts the cage 201 and the metal shell 1, a front end of the second electromagnetic shielding portion 313 mechanically and electrically and compressively contacts an edge of the cage 201 positioned at the opening 201*a*. Since the electromagnetic interference (EMI) in general case mainly affects the top portion 11 and the bottom portion 12 of the plug connector 100, with the conductive elastic member 3 which is provided on the top portion 11 and the bottom portion 12 of the metal shell 1 of the plug connector 100 and mechanically and electrically contacts the cage 201 and the metal shell 1, a gap between the cage 201 and the top portion 11 and bottom portion 12 of the metal shell 1 can be shielded, so as to prevent the electromagnetic interference (EMI) from leaking out from the gap. Furthermore, the first electromagnetic shielding portion 312 of the conductive elastic member 3, which is lower in height and positioned at the front, can enter into the opening 201*a* of the cage 201 of the receptacle connector 200 and mechanically and electrically contact the cage 201 and the metal shell 1, and the second electromagnetic shielding portion 313, which is higher in height and positioned at the rear, can make the front end thereof mechanically and electrically contact the edge of the cage 201 positioned at the opening 201*a*, so the conductive elastic member 3 has good shield sealing. The conductive elastic member 3 can be stably provided to the plug connector 100 through the engagement of the recessed groove 13 and the holding portion 311. In addition, the conductive elastic member 3 can also increase the mating stability between the plug connector 100 and the receptacle connector 200 during mating. In a variant embodiment, the metal shell 1 may also be provided with one recessed groove 13 extending in the left-right direction D2 only on one of the top portion 11 and the bottom portion 12, and the conductive elastic member 3 may also include only one conductive elastic body 31 extending in the left-right direction D2 and held in the one recessed groove 13, the present disclosure is not limited to the first embodiment.

In addition, the holding portion 311 of each conductive elastic body 31 is provided in the corresponding recessed groove 13 in a manner that the holding portion 311 and the corresponding recessed groove 13 interfere with each other in the front-rear direction D1, so as to strengthen the holding force between the holding portion 311 and the recessed groove 13. It should be noted that, in a variant embodiment, the metal shell 1 is not provided with the recessed groove 13, the conductive elastic body 31 does not have the holding portion 311, and the conductive elastic body 31 of the conductive elastic member 3 is held on the metal shell 1 by, for example, attaching, and in other embodiments, the conductive elastic body 31 can be held on the metal shell 1 in any manner with a sufficient holding force, so the present disclosure is not limited to the first embodiment.

In the first embodiment, the front end of each first electromagnetic shielding portion 312 has a guiding structure 312*a*, the guiding structure 312*a* has a guiding surface 312*b* which is arc surface and extends obliquely toward the rear and away from the metal shell 1, the guiding surface 312*b* may have, for example, an oblique surface shape, so the present disclosure is not limited to the first embodiment. With the guiding surface 312*b* extending obliquely, the first electromagnetic shielding portions 312 can more easily enter into the opening 201*a* of the cage 201 of the receptacle connector 200 when the plug connector 100 is inserted forwardly into the receptacle connector 200. In addition, each conductive elastic body 31 further has a supporting portion 314 which is positioned behind the second electromagnetic shielding portion 313, connected to the second electromagnetic shielding portion 313 and abuts against the metal shell 1. In the first embodiment, a cross section of the supporting portion 314 is a right triangle, two sides of which respectively abuts against the second electromagnetic shielding portion 313 and the metal shell 1, but the present disclosure is not limited thereto. The supporting portion 314 provides a supporting force to the second electromagnetic shielding portion 313, so as to prevent the second electromagnetic shielding portion 313 from turning rearwardly due to the torque generated by the rearward force exerted by the edge of the cage 201 of the receptacle connector 200, thereby further strengthening the structural strength of the conductive elastic body 31.

Figure 10:
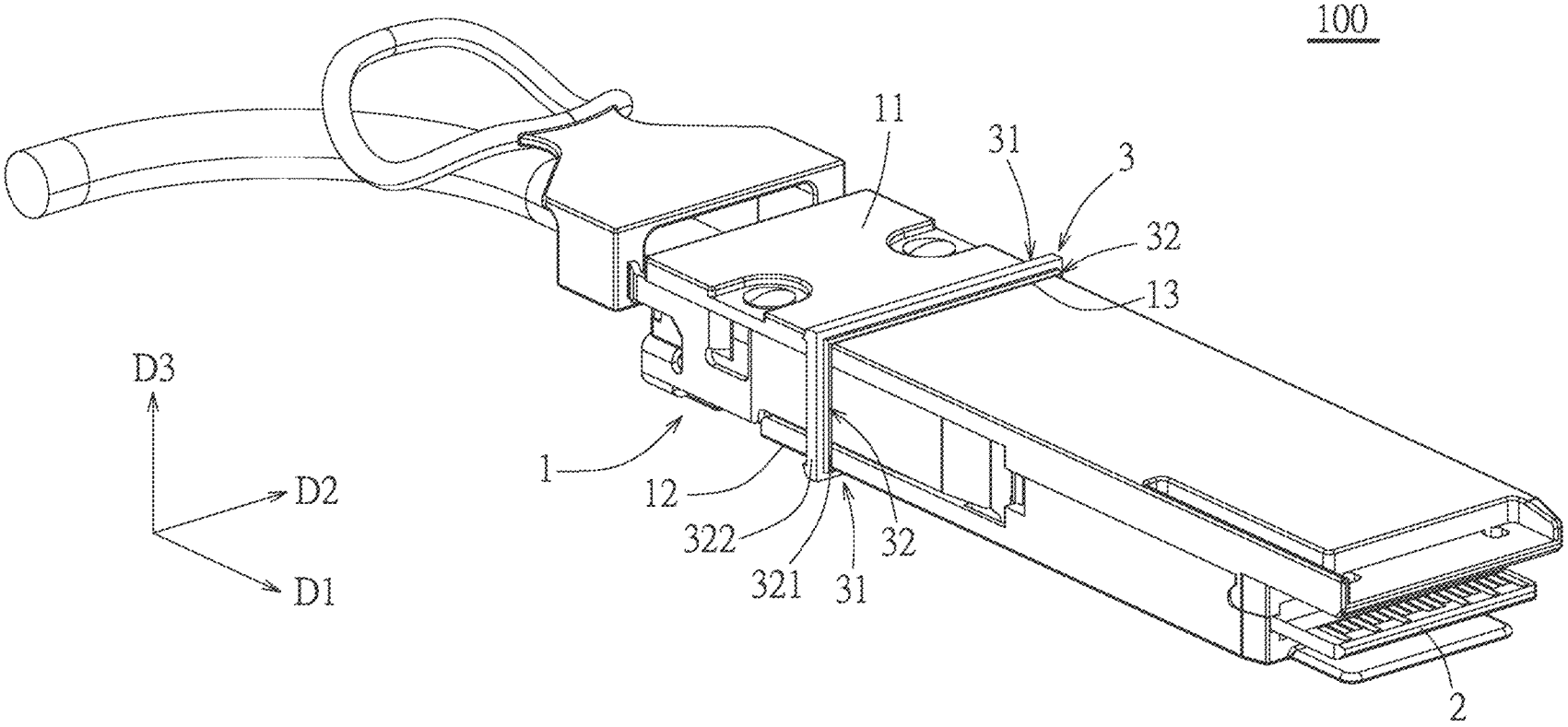
FIG. 10 is a perspective view of a second embodiment of the plug connector of the present disclosure.
Figure 11:
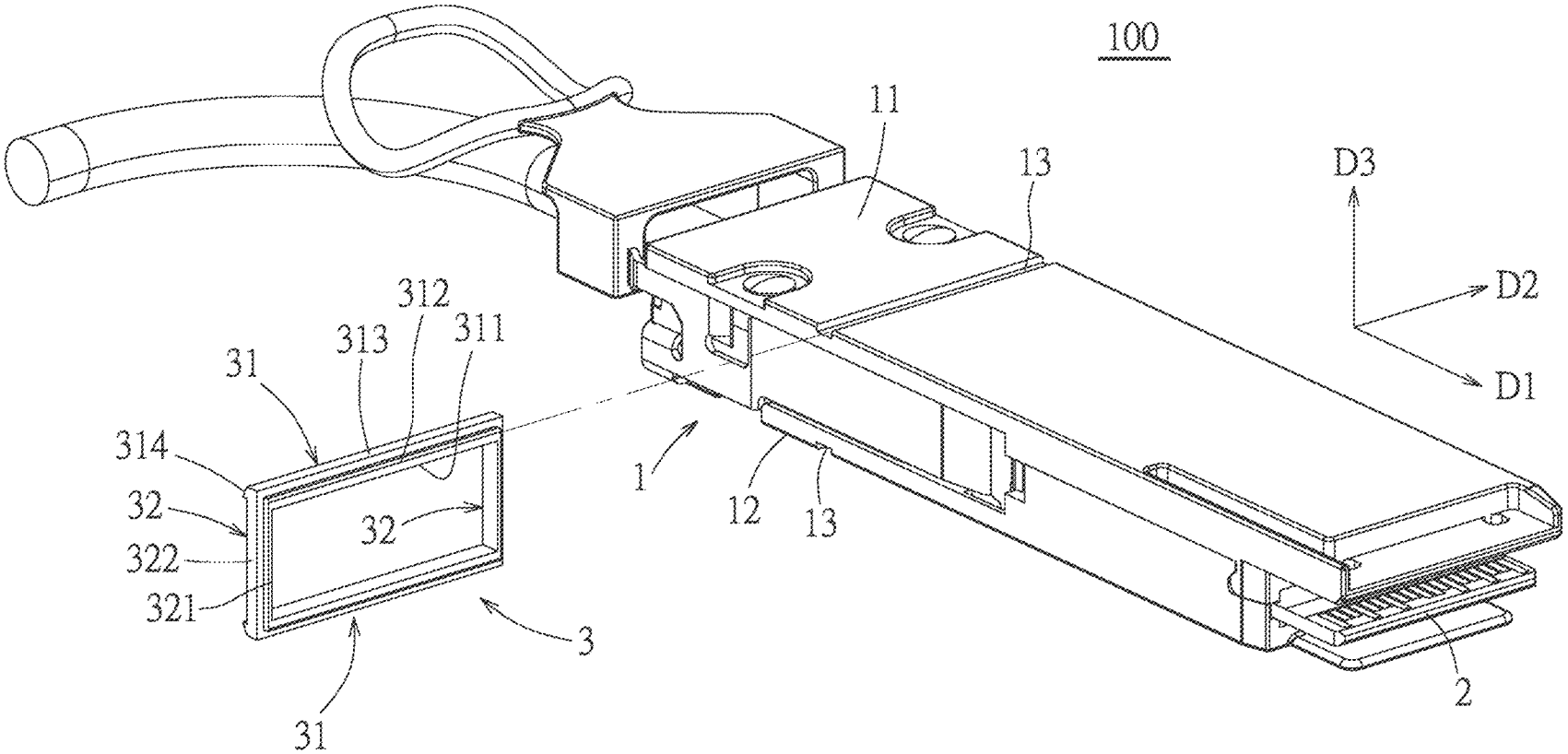
FIG. 11 is an exploded perspective view of FIG. 10, in which a conductive elastic member of the second embodiment is separated from a metal shell.
Figure 12:
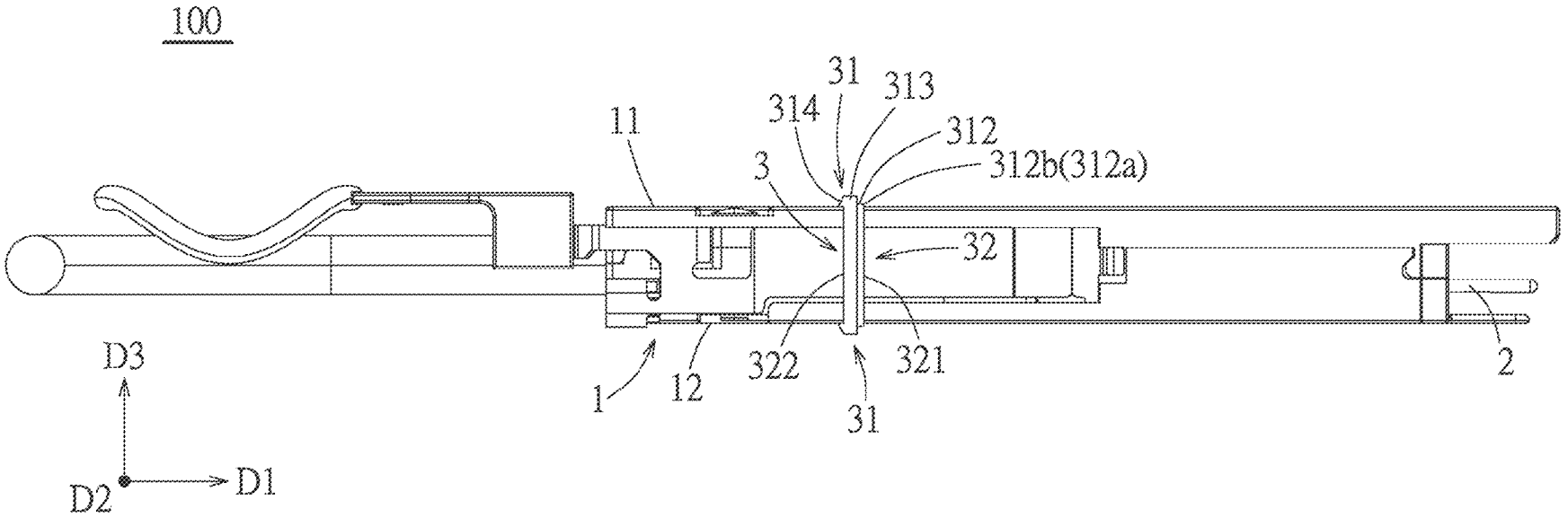
FIG. 12 is a side view of the second embodiment.

Referring FIG. 10 to FIG. 12, a second embodiment of the plug connector 100 of the present disclosure differs from the first embodiment in that, in the second embodiment, the conductive elastic member 3 further includes two side conductive elastic bodies 32 which extend in the up-down direction D3 and are respectively connected to two ends of the two conductive elastic bodies 31 and respectively abut against both sides of the metal shell 1. Each side conductive elastic body 32 has a third electromagnetic shielding portion 321 and a fourth electromagnetic shielding portion 322 behind the third electromagnetic shielding portion 321, a height of the third electromagnetic shielding portion 321 relative to the metal shell 1 is lower than a height of the fourth electromagnetic shielding portion 322 relative to the metal shell 1. The third electromagnetic shielding portion 321 of the side conductive elastic body 32 is connected between two ends of the first electromagnetic shielding portions 312 of the two conductive elastic bodies 31, and the fourth electromagnetic shielding portion 322 of the side conductive elastic body 32 is connected between two ends of the second electromagnetic shielding portions 313 of the two conductive elastic bodies 31. When the plug connector 100 is inserted forwardly into the receptacle connector 200, the third electromagnetic shielding portion 321 enters into the opening 201*a* of the cage 201 of the receptacle connector 200 (see FIG. 1) and mechanically and electrically contacts the cage 201 and the metal shell 1, the fourth electromagnetic shielding portion 322 mechanically and electrically contacts the edge of the cage 201 positioned at the opening 201*a*. The side conductive elastic bodies 32 can improve the shield sealing of the conductive elastic member 3 against the electromagnetic interference (EMI) on the left and right sides, and the side conductive elastic bodies 32 make the conductive elastic member 3 have a ring shape so that the conductive elastic member 3 can be sheathed on the metal shell 1, thereby increasing the holding force between the metal shell 1 and the conductive elastic member 3. In addition, it should be noted that although the connection relationship between the metal shell 1 and the two side conductive elastic bodies 32 is only the relationship of abutting each other in the second embodiment, in a variant embodiment, the metal shell 1 may also be provided with recessed grooves 13 corresponding to the side conductive elastic bodies 32, and the side conductive elastic bodies 32 each may have a holding portion 311 held in the recessed groove 13, so the present disclosure is not limited to the second embodiment.

Figure 13:
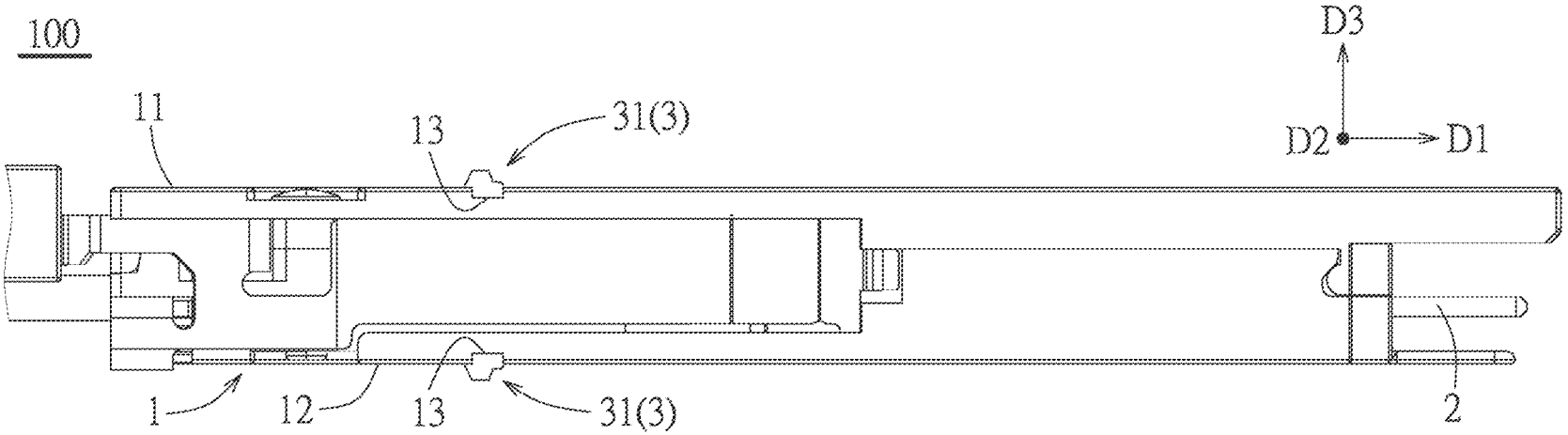
FIG. 13 is a side view of a third embodiment of the plug connector of the present disclosure.
Figure 14:
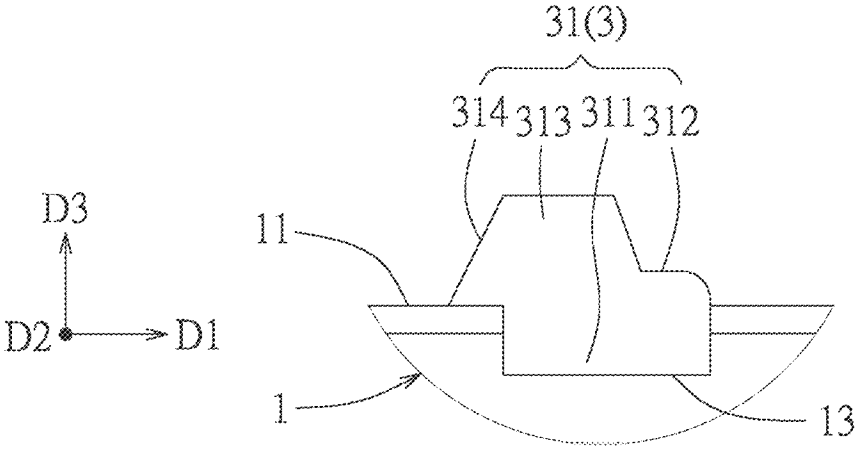
FIG. 14 is an incomplete partial enlarged view of FIG. 13.

Referring FIG. 13 and FIG. 14, a third embodiment of the plug connector 100 of the present disclosure differs from the first embodiment in that, in the third embodiment, a front end face of the second electromagnetic shielding portion 313 of each conductive elastic body 31 extends obliquely toward the rear and away from the metal shell 1.

Figure 15:
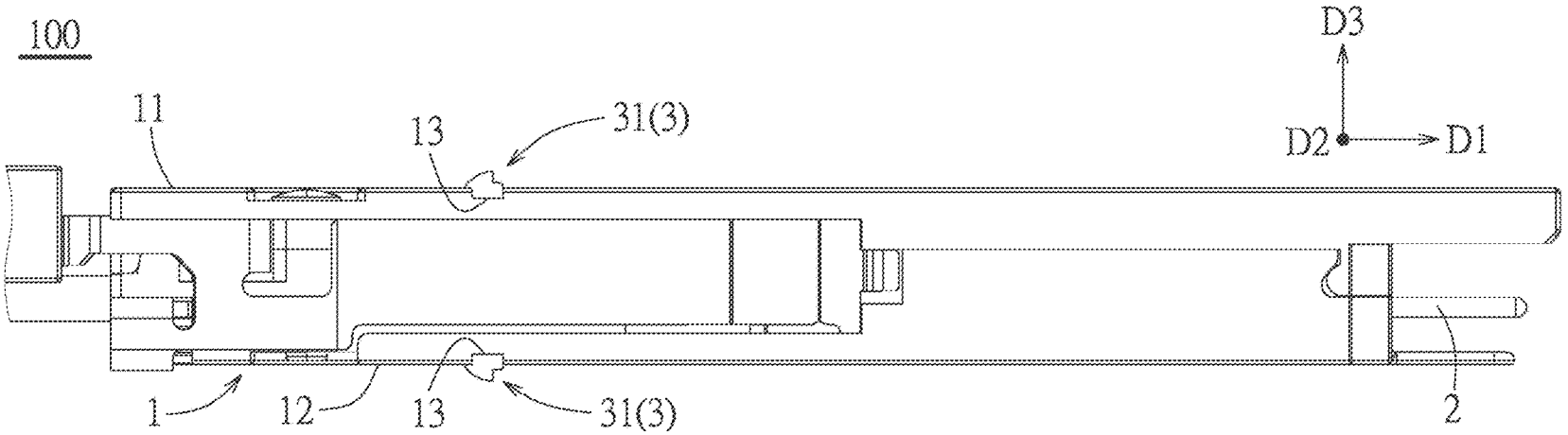
FIG. 15 is a side view of a fourth embodiment of the plug connector of the present disclosure.
Figure 16:
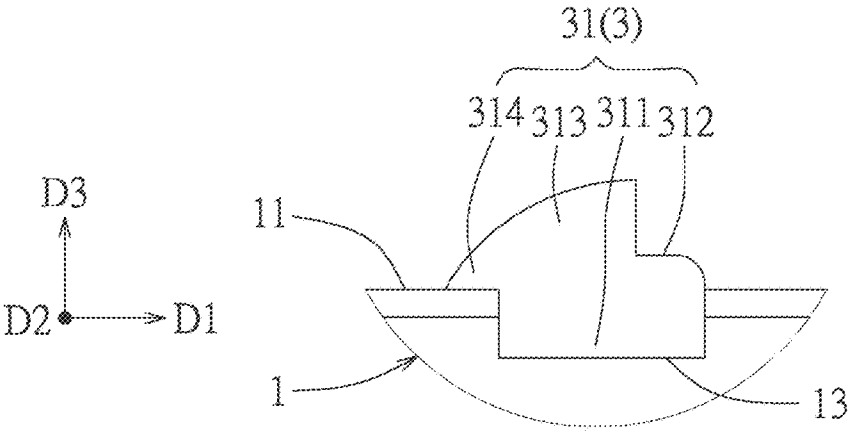
FIG. 16 is an incomplete partial enlarged view of FIG. 15.

Referring FIG. 15 and FIG. 16, a fourth embodiment of the plug connector 100 of the present disclosure differs from the first embodiment in that, in the fourth embodiment, a top surface of each conductive elastic body 31 is positioned on the second electromagnetic shielding portion 313 and the supporting portion 314 and has an arc shape extending obliquely toward the rear and a direction approaching the metal shell 1.

Figure 17:
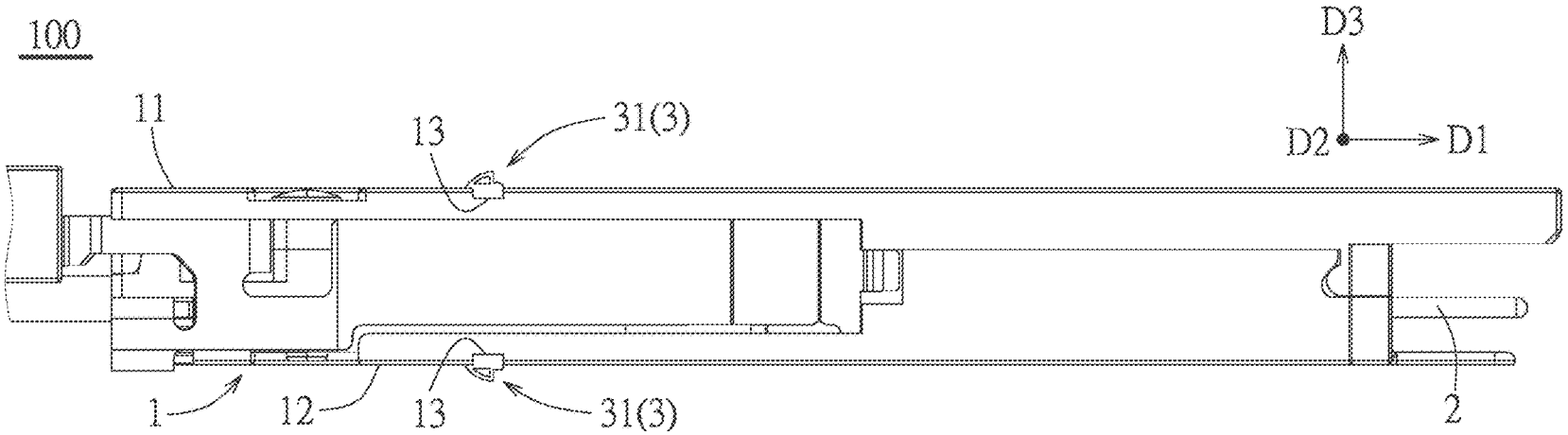
FIG. 17 is a side view of a fifth embodiment of the plug connector of the embodiment disclosure.
Figure 18:
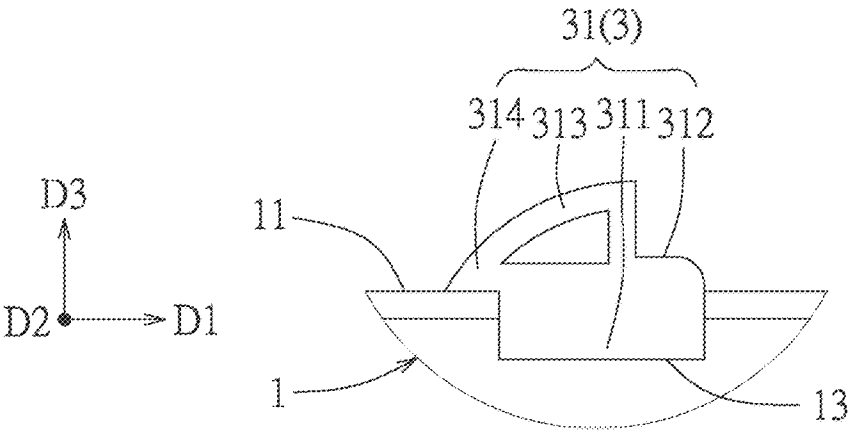
FIG. 18 is an incomplete partial enlarged view of FIG. 17.

Referring FIG. 17 and FIG. 18, a fifth embodiment of the plug connector 100 of the present disclosure differs from the fourth embodiment in that, in the fifth embodiment, an interior of the second electromagnetic shielding portion 313 of each conductive elastic body 31 is hollow, thereby reducing the used material of the conductive elastic member 3 to save costs.

Figure 19:
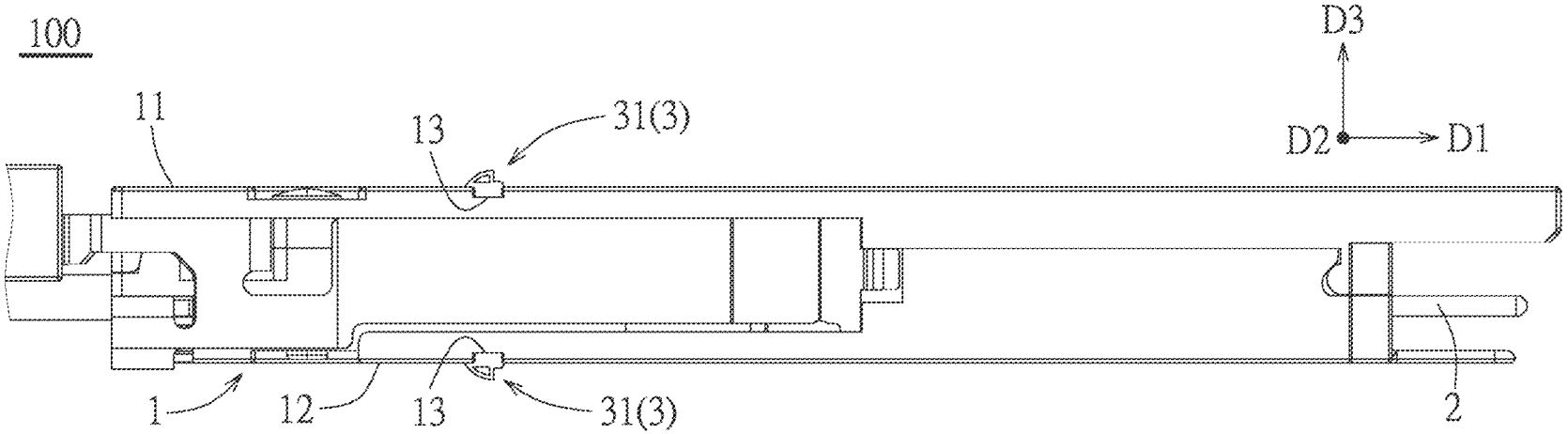
FIG. 19 is a side view of a sixth embodiment of the plug connector of the present disclosure.
Figure 20:
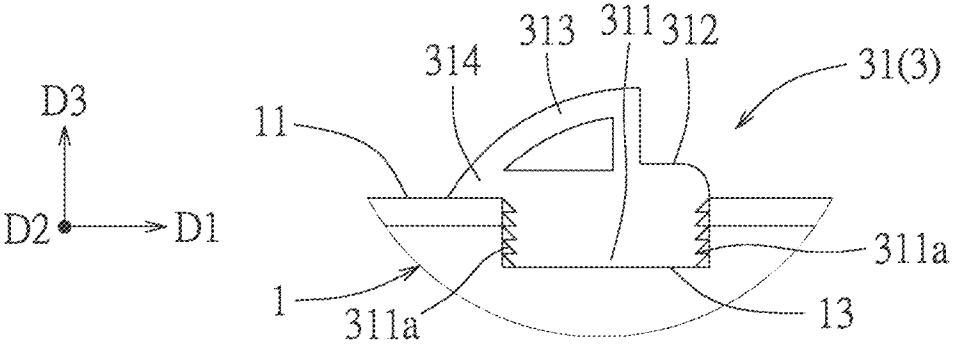
FIG. 20 is an incomplete partial enlarged view of FIG. 19.

Referring FIG. 19 and FIG. 20, a sixth embodiment of the plug connector 100 of the present disclosure differs from the fifth embodiment in that, in the sixth embodiment, the holding portion 311 of each conductive elastic body 31 has tooth-shape structures 311*a* which are respectively positioned at a front end and a rear end and are in form of barb shape and interfere with the corresponding recessed groove 13, thereby strengthening the holding force between the holding portion 311 and the recessed groove 13, so as to further prevent the conductive elastic member 3 from falling off from the metal shell 1.

Figure 21:
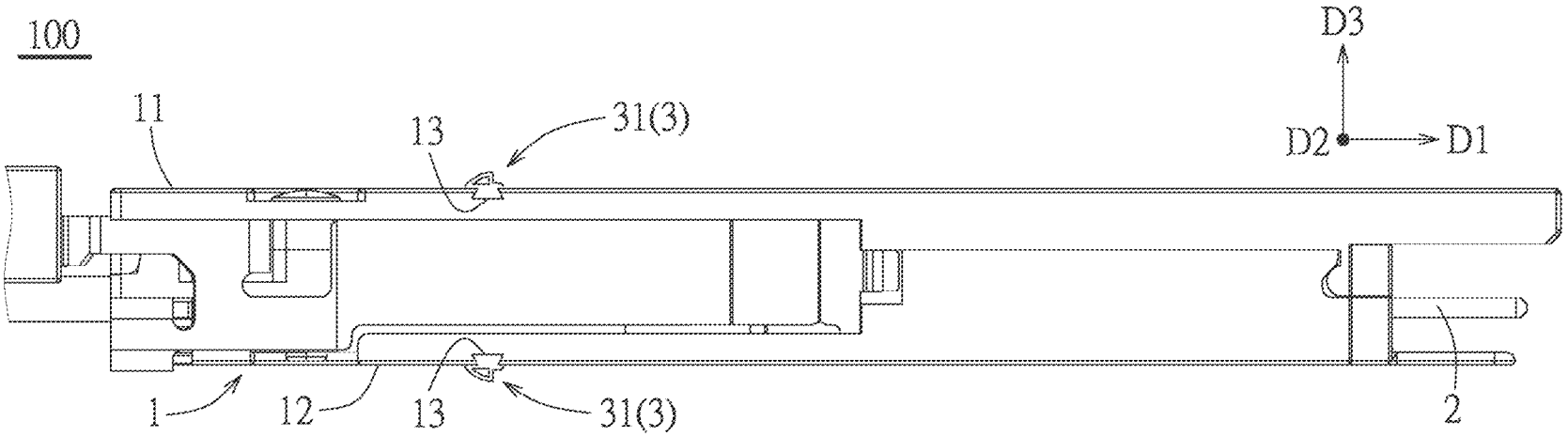
FIG. 21 is a side view of a seventh embodiment of the plug connector of the present disclosure.
Figure 22:
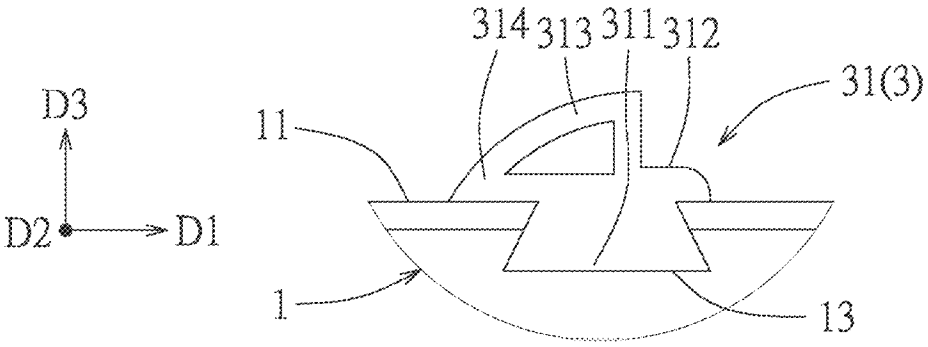
FIG. 22 is an incomplete partial enlarged view of FIG. 21.

Referring FIG. 21 and FIG. 22, a seventh embodiment of the plug connector 100 of the present disclosure differs from the fifth embodiment in that, in the seventh embodiment, a cross section of the recessed groove 13 of the metal shell 1 and a cross section of the holding portion 311 of the conductive elastic member 3 each are an isosceles trapezoid whose width gradually decreases in a direction away from the metal shell 1. Therefore, the holding force between the holding portion 311 and the recessed groove 13 can be strengthened to further prevent the conductive elastic member 3 from separating from metal shell 1.

Figure 23:
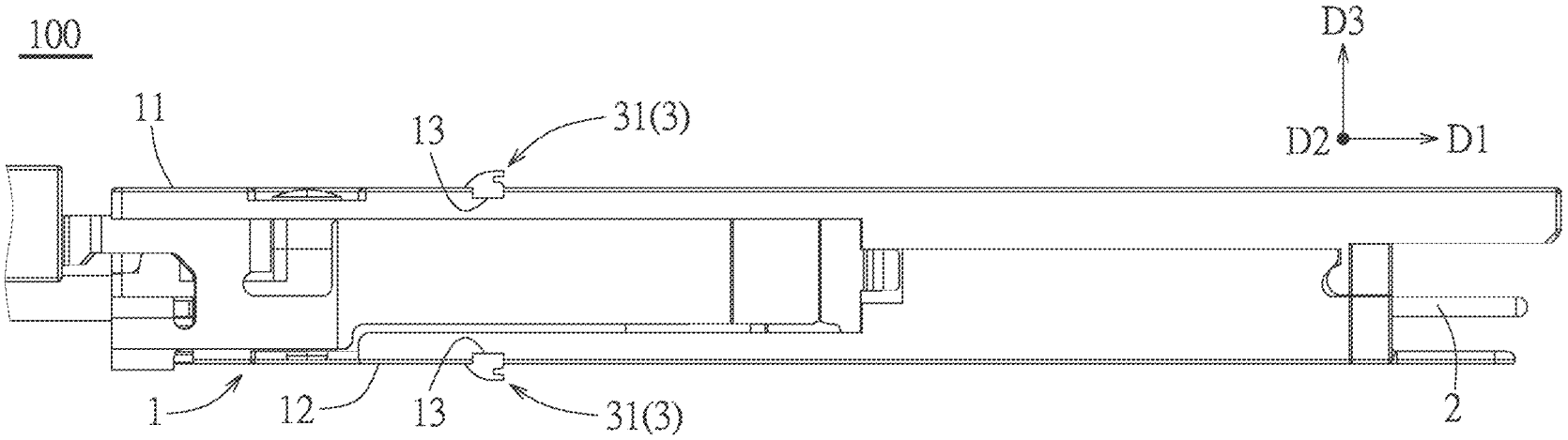
FIG. 23 is a side view of an eighth embodiment of the plug connector of the present disclosure.
Figure 24:
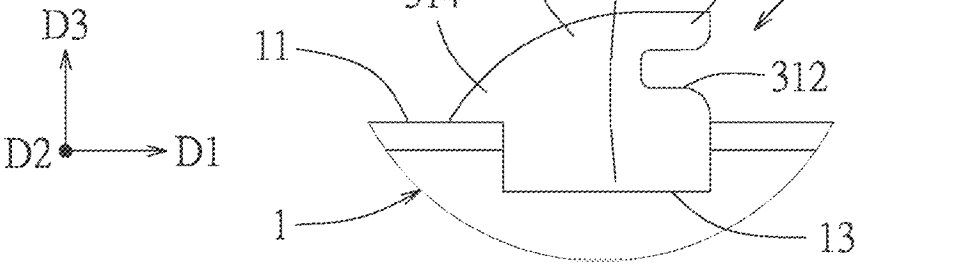
FIG. 24 is an incomplete partial enlarged view of FIG. 23.

Referring FIG. 23 and FIG. 24, an eighth embodiment of the plug connector 100 of the present disclosure differs from the first embodiment in that, in the eighth embodiment, each conductive elastic body 31 further has a fifth electromagnetic shielding portion 315 connected to a front end of the second electromagnetic shielding portion 313 at a position away from the metal shell 1, the fifth electromagnetic shielding portion 315 covers the edge of the cage 201 when the plug connector 100 is inserted forwardly into the receptacle connector 200, thereby strengthening the shield sealing of the conductive elastic member 3 to the electromagnetic interference (EMI).

Figure 25:
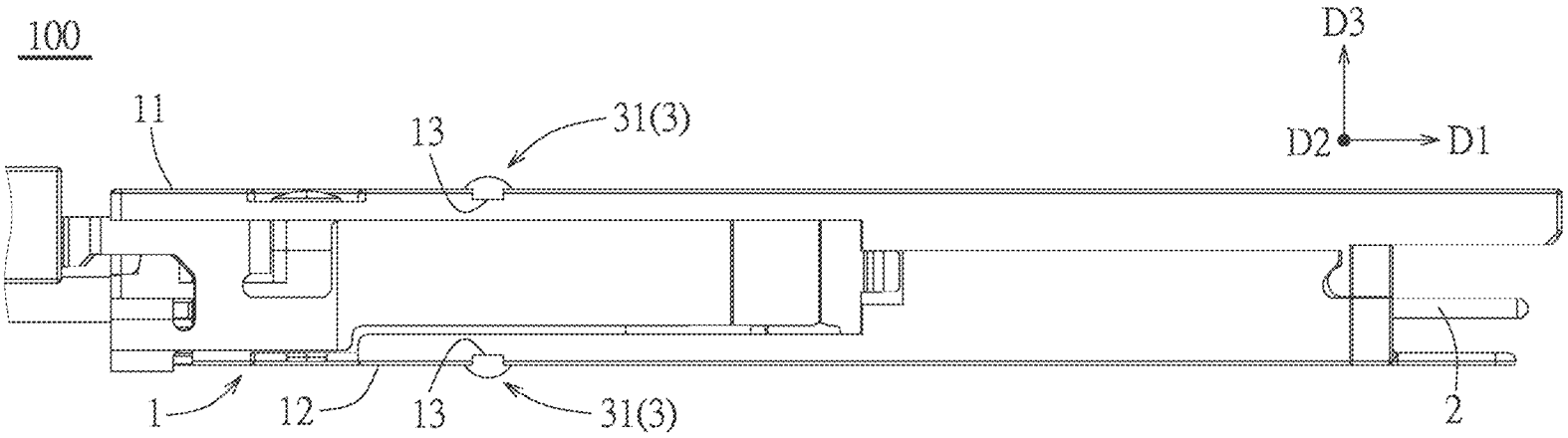
FIG. 25 is a side view of a ninth embodiment of the plug connector of the present disclosure.
Figure 26:
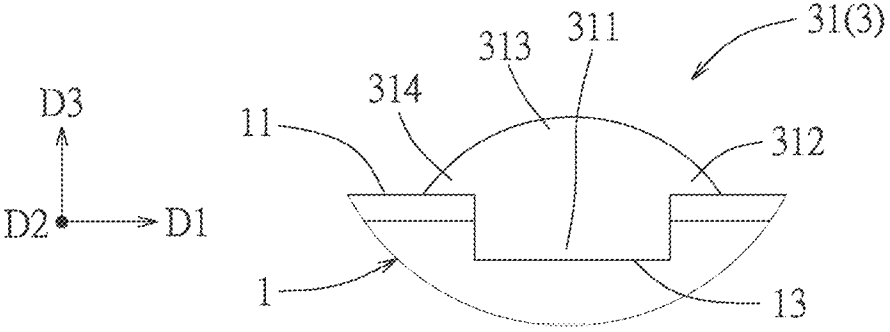
FIG. 26 is an incomplete partial enlarged view of FIG. 25.

Referring FIG. 25 and FIG. 26, a ninth embodiment of the plug connector 100 of the present disclosure differs from the first embodiment in that, in the ninth embodiment, the first electromagnetic shielding portion 312, the second electromagnetic shielding portion 313 and the supporting portion 314 of each conductive elastic body 31 together form a structure with a cross section generally as a part of a circle.

In conclusion, in the plug connector 100 of the present disclosure, the gap between the cage 201 and the metal shell 1 is shielded by the conductive elastic member 3 which mechanically and electrically contacts the cage 201 and the metal shell 1 so as to prevent the electromagnetic interference (EMI) from leaking out from the gap. Furthermore, the first electromagnetic shielding portion 312 of the conductive elastic member 3, which is lower in height and positioned at the front, can enter into the opening 201*a* of the cage 201 of the receptacle connector 200 and mechanically and electrically contacts the cage 201 and the metal shell 1, and the second electromagnetic shielding portion 313, which is higher in height and positioned at the rear, can make the front end thereof mechanically and electrically contact the edge of the cage 201 poisoned at the opening 201*a*, so that the conductive elastic member 3 has good shield sealing. The conductive elastic member 3 can be stably provided to the plug connector 100 through the engagement of the recessed groove 13 and the holding portion 311. In addition, the conductive elastic member 3 can also increase the mating stability of the plug connector 100 and the receptacle connector 200 during mating.

However, the above description is only for the embodiments of the present disclosure, and it is not intended to limit the implementing scope of the present disclosure, and the equivalent changes and modifications made according to the claims and the contents of the specification are still included in the scope of the present disclosure.

What is claimed is:

1. A plug connector configured to be inserted into a receptacle connector with a cage having an opening, the plug connector comprising:

a metal shell provided with a recessed groove; and a conductive elastic member comprising a conductive elastic body, the conductive elastic body having a holding portion held in the recessed groove and a first electromagnetic shielding portion extending out of the recessed groove from the holding portion, the first electromagnetic shielding portion being in mechanical and electrical contact with both the metal shell and a cage of a receptacle connector on at least two opposing sides of the plug connector when the plug connector has been fully inserted into an opening of the cage.

2. The plug connector of claim 1, wherein the conductive elastic body further has a second electromagnetic shielding portion which is positioned behind the first electromagnetic shielding portion, when the plug connector is inserted fully into the receptacle connector, the second electromagnetic shielding portion mechanically and electrically contacts an edge of the cage positioned at the opening.

3. The plug connector of claim 2, wherein the metal shell comprises a top portion and a bottom portion, the recessed groove is provided to one of the top portion and the bottom portion.

4. The plug connector of claim 2, wherein the metal shell comprises a top portion and a bottom portion, the recessed groove is provided to one of the top portion and the bottom portion, the metal shell is further provided with another recessed groove provided to the other of the top portion and the bottom portion, the conductive elastic member further comprises another conductive elastic body provided to the another recessed groove.

5. The plug connector of claim 4, wherein the another conductive elastic body has a holding portion held in the another recessed groove and a first electromagnetic shielding portion extending out of the another recessed groove from the holding portion of the another conductive elastic body, when the plug connector is inserted fully into the receptacle connector, the first electromagnetic shielding portion of the another conductive elastic body has entered into the opening of the cage of the receptacle connector and is mechanically and electrically contacting the cage and the metal shell.

6. The plug connector of claim 5, wherein the another conductive elastic body further has a second electromagnetic shielding portion which is positioned behind the first electromagnetic shielding portion of the another conductive elastic body, when the plug connector is inserted fully into the receptacle connector, the second electromagnetic shielding portion of the another conductive elastic body is mechanically and electrically contacting the edge of the cage positioned at the opening.

7. The plug connector of claim 6, wherein the conductive elastic member further comprises two side conductive elastic bodies which are respectively connected to two ends of the conductive elastic bodies.

8. The plug connector of claim 7, wherein each side conductive elastic body has a third electromagnetic shielding portion, when the plug connector is inserted fully into the receptacle connector, the third electromagnetic shielding portion has entered into the opening of the cage of the receptacle connector and is mechanically and electrically contacting the cage and the metal shell; and further wherein each side conductive elastic body further has a fourth electromagnetic shielding portion which is positioned behind the third electromagnetic shielding portion, when the plug connector is inserted fully into the receptacle connector, the fourth electromagnetic shielding portion is mechanically and electrically contacting the edge of the cage positioned at the opening.

9. The plug connector of claim 1, wherein a front end of the first electromagnetic shielding portion has a guiding structure, the guiding structure has a guiding surface which is an oblique surface or an arc surface extending obliquely toward the rear and away from the metal shell.

10. The plug connector of claim 2, wherein the conductive elastic body further has a supporting portion which is positioned behind the second electromagnetic shielding portion of the conductive elastic body and abuts against the metal shell.

11. The plug connector of claim 6, wherein the conductive elastic body further has a supporting portion which is positioned behind the second electromagnetic shielding portion of the conductive elastic body and abuts against the metal shell, and the another conductive elastic body further has a supporting portion which is positioned behind the second electromagnetic shielding portion of the another conductive elastic body and abuts against the metal shell.

12. The plug connector of claim 1, wherein a material of the conductive elastic member is conductive rubber or conductive foam.

13. A plug connector configured to be inserted into a receptacle connector with a cage having an opening, the plug connector comprising:

a metal shell with a top portion and a bottom portion; and a conductive elastic member comprising a conductive elastic body held to the metal shell, the conductive elastic body having a first electromagnetic shielding portion and a second electromagnetic shielding portion positioned behind the first electromagnetic shielding portion, a height of the first electromagnetic shielding portion relative to the metal shell being lower than a height of the second electromagnetic shielding portion relative to the metal shell, the first electromagnetic shielding portion being in mechanical and electrical contact with both the metal shell and a cage of a receptacle connector along the top and bottom portions when the plug connector has been fully inserted into an opening of the cage, and the second electromagnetic shielding portion being in mechanical and electrical contact with an edge of the cage positioned at the opening.

14. The plug connector of claim 13, wherein the metal shell comprises a top portion and a bottom portion, the conductive elastic body is held to one of the top portion and the bottom portion.

15. The plug connector of claim 13, wherein the metal shell comprises a top portion and a bottom portion, wherein the conductive elastic body is held to one of the top portion and the bottom portion, wherein the conductive elastic member further comprises another conductive elastic body held to the other of the top portion and the bottom portion, and wherein the another conductive elastic body has a first electromagnetic shielding portion and a second electromagnetic shielding portion positioned behind the first electromagnetic shielding portion of the another conductive elastic body, a height of the first electromagnetic shielding portion of the another conductive elastic body relative to the metal shell is lower than a height of the second electromagnetic shielding portion of the another conductive elastic body relative to the metal shell, and when the plug connector is inserted forwardly into the receptacle connector, the first electromagnetic shielding portion of the another conductive elastic body enters into the opening of the cage of the receptacle connector and mechanically and electrically contacts the cage and the metal shell, the second electromagnetic shielding portion of the another conductive elastic body mechanically and electrically contacts the edge of the cage positioned at the opening.

16. The plug connector of claim 15, wherein the conductive elastic member further comprises two side conductive elastic bodies which are respectively connected to two ends of the two conductive elastic bodies;

wherein each conductive elastic body has a third electromagnetic shielding portion and when the plug connector is inserted forwardly into the receptacle connector, the third electromagnetic shielding portion enters into the opening of the cage of the receptacle connector and mechanically and electrically contacts the cage and the metal shell; and wherein each side conductive elastic body further has a fourth electromagnetic shielding portion positioned behind the third electromagnetic shielding portion and when the plug connector is inserted forwardly into the receptacle connector, the fourth electromagnetic shielding portion mechanically and electrically contacts the edge of the cage positioned at the opening.

17. The plug connector of claim 13, wherein the metal shell is provided with a recessed groove, the conductive elastic body further has a holding portion held in the recessed groove.

18. The plug connector of claim 15, wherein the metal shell is provided with recessed grooves, the conductive elastic body further has a holding portion held in the corresponding recessed groove, the another conductive elastic body further has a holding portion held in the corresponding recessed groove.

19. A plug connector configured to be inserted into a receptacle connector with a cage having an opening, the plug connector comprising:

a metal shell; and a conductive elastic member comprising a conductive elastic body held to the metal shell, the conductive elastic body having a first electromagnetic shielding portion and a second electromagnetic shielding portion positioned behind the first electromagnetic shielding portion, a height of the first electromagnetic shielding portion relative to the metal shell being lower than a height of the second electromagnetic shielding portion relative to the metal shell, the first electromagnetic shielding portion being in mechanical and electrical contact with the metal shell and a cage of a receptacle connector, when the plug connector has been fully inserted into an opening of the cage, and the second electromagnetic shielding portion being in mechanical and electrical contact with an edge of the cage positioned at the opening wherein the conductive elastic bodies further have a supporting portion positioned behind the second electromagnetic shielding portion of the conductive elastic body and abutting against the metal shell.

20. The plug connector of claim 15, wherein the conductive elastic body has a supporting portion positioned behind the second electromagnetic shielding portion of the conductive elastic body and abutting against the metal shell, and the another conductive elastic body further has a supporting portion positioned behind the second electromagnetic shielding portion of the another conductive elastic body and abutting against the metal shell.

* * * * *